US008556463B2

(12) United States Patent
Wang et al.

(10) Patent No.: US 8,556,463 B2
(45) Date of Patent: Oct. 15, 2013

(54) SIMPLE DETACHABLE ILLUMINATION STRUCTURE AND LAMP TUBE

(75) Inventors: Bily Wang, Hsinchu (TW); Chi-Tseng Chang, Taoyuan County (TW); Chi-Kang Lo, Hsinchu (TW); Zhen Hao Fan, Hsinchu County (TW)

(73) Assignee: Harvatek Corporation, Hsinchu (TW)

( * ) Notice: Subject to any disclaimer, the term of this patent is extended or adjusted under 35 U.S.C. 154(b) by 438 days.

(21) Appl. No.: 13/008,164

(22) Filed: Jan. 18, 2011

(65) Prior Publication Data

US 2012/0014087 A1 Jan. 19, 2012

(30) Foreign Application Priority Data

Jul. 14, 2010 (TW) ..... 99123212 A

(51) Int. Cl.
*F21S 4/00* (2006.01)

(52) U.S. Cl.
USPC ..... 362/249.02; 362/218; 362/217.17

(58) Field of Classification Search
USPC ..... 362/218, 217.08, 217.17, 249.02
See application file for complete search history.

(56) References Cited

U.S. PATENT DOCUMENTS

2009/0244909 A1* 10/2009 Chen ..... 362/368

* cited by examiner

*Primary Examiner* — David V Bruce
(74) *Attorney, Agent, or Firm* — Rosenberg, Klein & Lee

(57) ABSTRACT

A simple detachable illumination lamp tube includes a tube unit, a heat-dissipating unit, a light-emitting unit, a support unit and a lateral cover unit. The tube unit has a light-permitting hollow tube. The heat-dissipating unit has a heat-dissipating substrate received in the light-permitting hollow tube. The heat-dissipating substrate has two opposite lateral sides contacting the inner surface of the light-permitting hollow tube. The light-emitting unit has a plurality of strip light-emitting modules received in the light-permitting hollow tube. The strip light-emitting modules are disposed on the heat-dissipating substrate and electrically connected in sequence. The support unit has a plurality of support elements received in the light-permitting hollow tube and disposed between a bottom side of the heat-dissipating substrate and the inner surface of the light-permitting hollow tube. The lateral cover unit has two lateral covers installed on two ends of the light-permitting hollow tube.

14 Claims, 5 Drawing Sheets

SIMPLE DETACHABLE ILLUMINATION STRUCTURE AND LAMP TUBE

BACKGROUND OF THE INVENTION

1. Field of the Invention

The instant disclosure relates to an illumination structure and a lamp tube, and more particularly, to a simple detachable illumination structure and lamp tube.

2. Description of Related Art

The invention of the lamp greatly changed the style of building construction and the living style of human beings, allowing people to work during the night. Traditional lighting devices such as lamps that adopt incandescent bulbs, fluorescent bulbs, or power-saving bulbs have been generally well-developed and used intensively indoor illumination. However, compared to the newly developed light-emitting-diode (LED) lamps, these traditional lamps have the disadvantages of quick attenuation, high power consumption, high heat generation, short working life, high fragility, and being not recyclable. Thus, various high-powered LED lamps are created to replace the traditional lighting devices. Among them, tubular LED lamps are gaining popularity for their dimensional resemblance of traditional fluorescent tubes and thus their adoptability to existing lighting devices.

However, it is essential for a transparent tube of LED lamp to design retaining structures on the inner surface of the hollow transparent tube of the prior art, thus a circuit board with light-emitting modules can be retained in the hollow transparent tube through the retaining structures. Moreover, the light-emitting modules always are electrically fixed on the circuit board through screws, thus it is not easy for user to replace the light-emitting modules. In addition, Moreover, the light-emitting modules can not be replaced individually, thus if one of the light-emitting modules needs to be replaced, all of the light-emitting modules need to be replaced at the same time.

SUMMARY OF THE INVENTION

One particular aspect of the instant disclosure is to provide a simple detachable illumination structure for user to individually replace light-emitting modules easily.

Another particular aspect of the instant disclosure is to provide a simple detachable illumination lamp tube for user to individually replace light-emitting modules easily and retain light-emitting modules in light-permitting hollow tube easily.

To achieve the above-mentioned advantages, the instant disclosure provides a simple detachable illumination structure, including: a heat-dissipating unit and a light-emitting unit. The heat-dissipating unit has at least one heat-dissipating substrate. The light-emitting unit has a plurality of strip light-emitting modules that are detachably disposed on the at least one heat-dissipating substrate and are electrically connected in sequence. Each strip light-emitting module has a circuit substrate, a plurality of light-emitting elements electrically connected and disposed on the circuit substrate and a package resin disposed on the circuit substrate to cover the light-emitting elements.

To achieve the above-mentioned advantages, the instant disclosure provides a simple detachable illumination lamp tube, including: a tube unit, a heat-dissipating unit, a light-emitting unit, a support unit and a lateral cover unit. The tube unit has a light-permitting hollow tube. The heat-dissipating unit has at least one heat-dissipating substrate received in the light-permitting hollow tube, and the at least one heat-dissipating substrate has two opposite lateral sides contacting the inner surface of the light-permitting hollow tube. The light-emitting unit has a plurality of strip light-emitting modules received in the light-permitting hollow tube. The strip light-emitting modules are detachably disposed on the at least one heat-dissipating substrate and electrically connected in sequence, and each strip light-emitting module has a circuit substrate, a plurality of light-emitting elements electrically connected and disposed on the circuit substrate and a package resin disposed on the circuit substrate to cover the light-emitting elements. The support unit has a plurality of support elements received in the light-permitting hollow tube and disposed on a bottom surface of the light-permitting hollow tube, and each support element is positioned between the bottom surface of the at least one heat-dissipating substrate and the inner surface of the light-permitting hollow tube. The lateral cover unit has two lateral covers installed on two ends of the light-permitting hollow tube, and each lateral cover has a cover body and at least two conductive pins passing through the cover body and respectively electrically connected to the light-emitting unit.

To achieve the above-mentioned advantages, the instant disclosure provides a simple detachable illumination lamp tube, including: a tube unit, a heat-dissipating unit, a light-emitting unit, a support unit and a lateral cover unit. The tube unit has a light-permitting hollow tube. The heat-dissipating unit has at least one heat-dissipating substrate received in the light-permitting hollow tube, and the at least one heat-dissipating substrate has two opposite lateral sides contacting the inner surface of the light-permitting hollow tube. The light-emitting unit has a plurality of strip light-emitting modules received in the light-permitting hollow tube, and the strip light-emitting modules are disposed on the at least one heat-dissipating substrate and electrically connected in sequence. The support unit has a plurality of support elements received in the light-permitting hollow tube and disposed on a bottom surface of the light-permitting hollow tube, and each support element is positioned between the bottom surface of the at least one heat-dissipating substrate and the inner surface of the light-permitting hollow tube. The lateral cover unit has two lateral covers installed on two ends of the light-permitting hollow tube, and each lateral cover has a cover body and at least two conductive pins passing through the cover body and respectively electrically connected to the light-emitting unit.

Therefore, because the strip light-emitting modules can be positioned on the heat-dissipating substrate through heat-conducting adhesive glue, the strip light-emitting modules can be detachably disposed on the heat-dissipating substrate. In addition, the heat-dissipating substrate can be pushed upward to the end through the elastic force generated by the elastic support elements, thus the two opposite lateral sides of the heat-dissipating substrate can tightly touch the inner surface of the light-permitting hollow tube for firmly positioning the heat-dissipating substrate in the light-permitting hollow tube.

To further understand the techniques, means and effects the instant disclosure takes for achieving the prescribed objectives, the following detailed descriptions and appended drawings are hereby referred, such that, through which, the purposes, features and aspects of the instant disclosure can be thoroughly and concretely appreciated. However, the appended drawings are provided solely for reference and illustration, without any intention that they be used for limiting the instant disclosure.

DETAILED DESCRIPTION OF THE PREFERRED EMBODIMENTS

Figure 1:
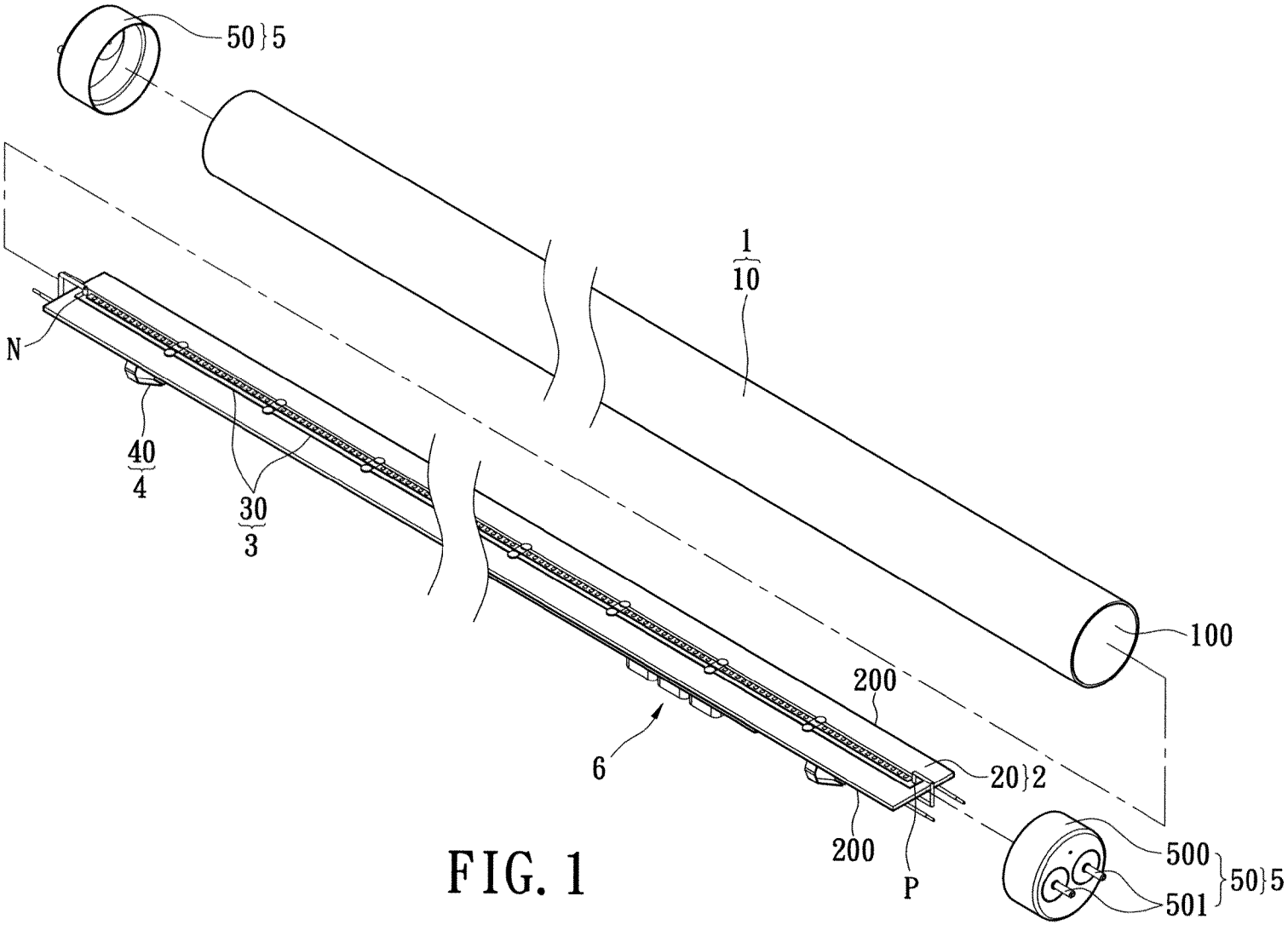
FIG. 1 shows one perspective, exploded, schematic view of the simple detachable illumination lamp tube according to the instant disclosure.

Referring to FIGS. 1 to 7, the instant disclosure provides a simple detachable illumination lamp tube, including a tube unit 1, a heat-dissipating unit 2, a light-emitting unit 3, a support unit 4 and a lateral cover unit 5.

Figure 2:
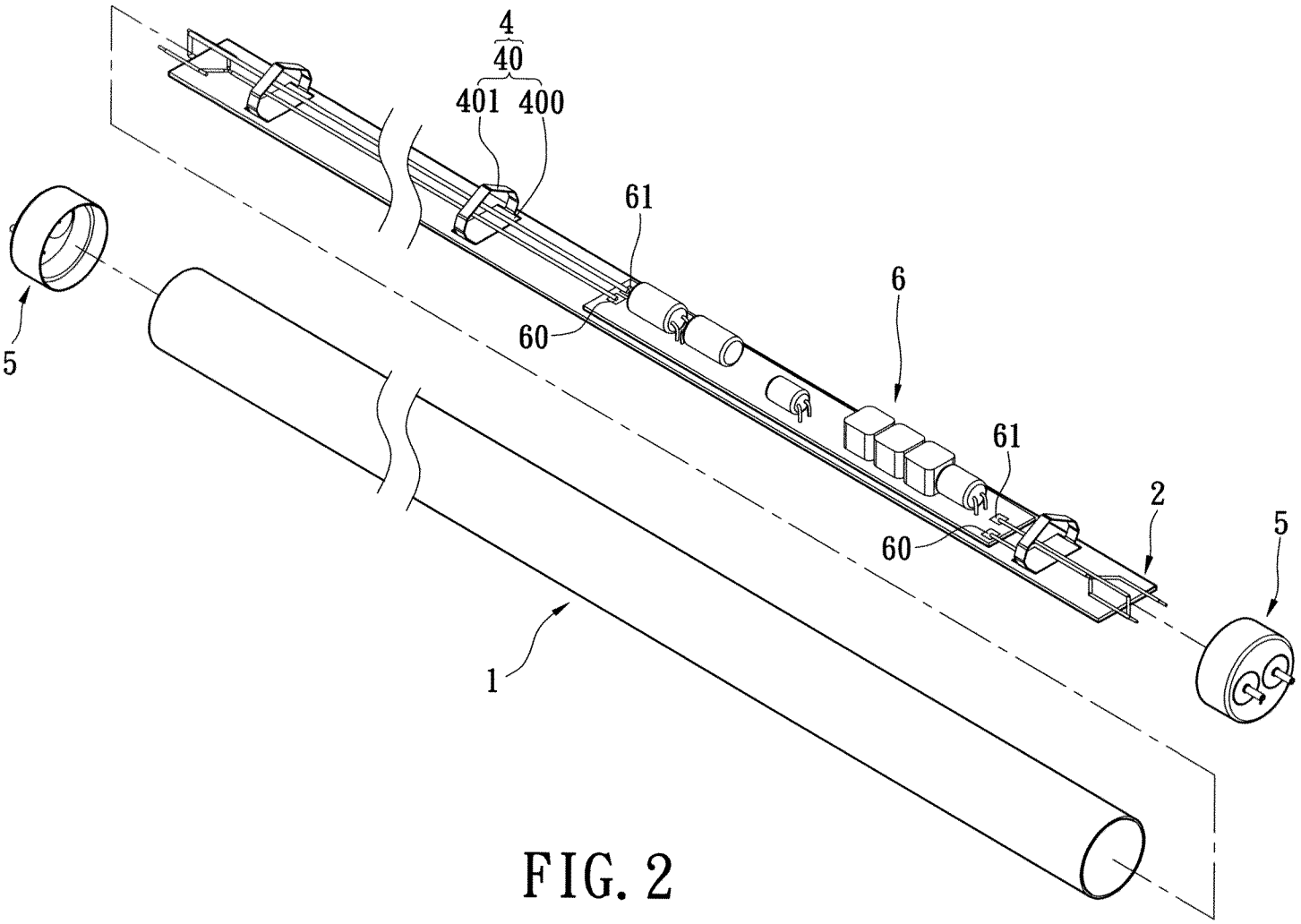
FIG. 2 shows another perspective, exploded, schematic view of the simple detachable illumination lamp tube according to the instant disclosure.
Figure 3:
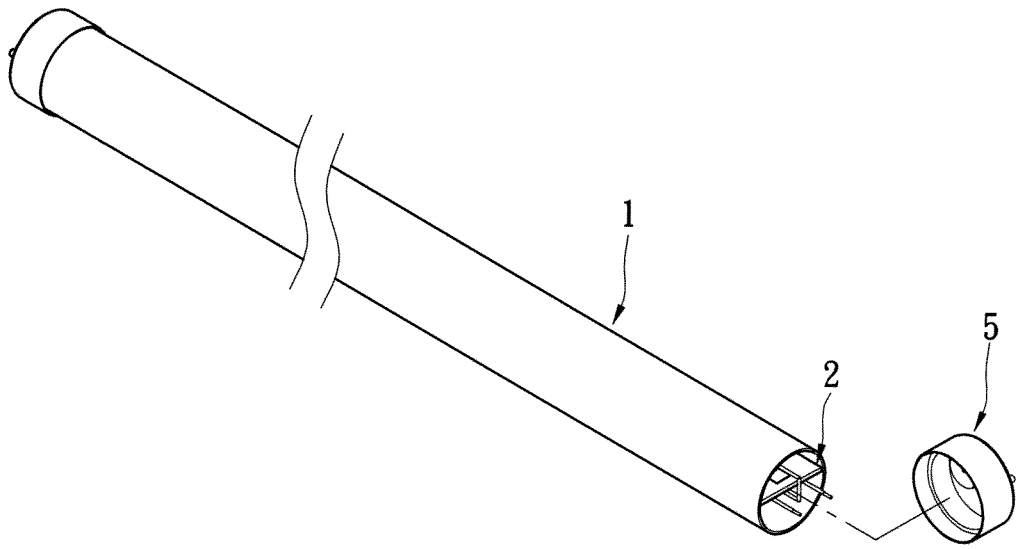
FIG. 3 shows a partial, perspective, assembled, schematic view of the simple detachable illumination lamp tube according to the instant disclosure.

Referring to FIGS. 1, 2 and 3, the tube unit 1 has a light-permitting hollow tube 10. For example, the light-permitting hollow tube 10 may be made of glass material, light-permitting plastic material or any type of light-permitting material, and an atomization surface or a roughened surface can be formed on an inner surface 100 of the light-permitting hollow tube 10. Hence, when light beams generated by the light-emitting unit 3 pass through the atomization surface or the roughened surface of the light-permitting hollow tube 10, the light beams would be uniformly projected outward from the illumination lamp tube of the instant disclosure.

Figure 6:
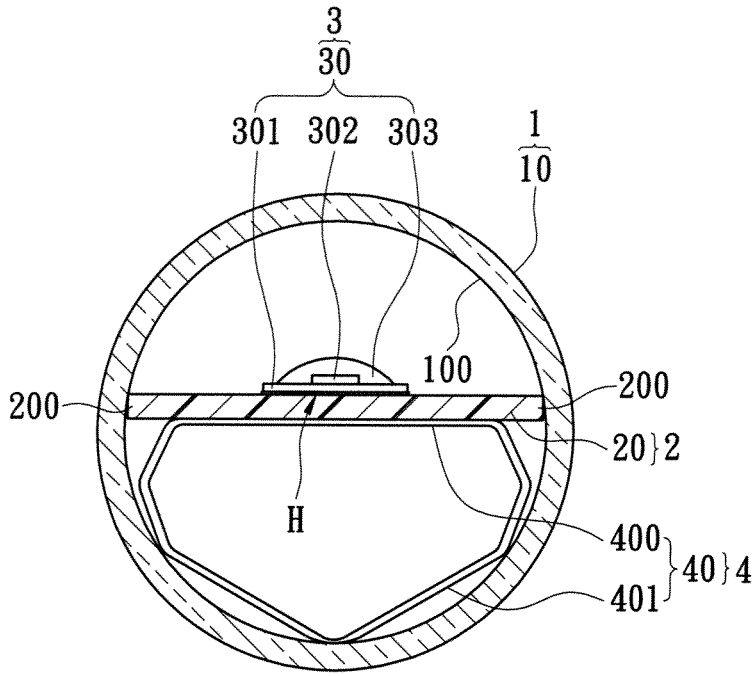
FIG. 6 shows a lateral, cross-sectional, schematic view of the tube unit, the heat-dissipating unit, the light-emitting unit and the support unit mated with each other according to the instant disclosure.

Referring to FIGS. 1, 2, 3 and 6, the heat-dissipating unit 2 has at least one heat-dissipating substrate 20 received in the light-permitting hollow tube 10, and the heat-dissipating substrate 20 has two opposite lateral sides 200 contacting the inner surface 100 of the light-permitting hollow tube 10 along the direction of the longitudinal axis of the tube unit as shown in FIG. 6. For example, when the heat-dissipating substrate 20 is received in the light-permitting hollow tube 10, one part of each lateral side 200 is adjacent to the lateral cover unit 5 and firmly jointed with the inner surface 100 of the light-permitting hollow tube 10 by spot soldering or other method as shown in FIG. 3. Of course, the two opposite lateral sides 200 of the heat-dissipating substrate 20 can directly contact the inner surface 100 of the light-permitting hollow tube 10 without using any other medium. In other words, the heat-dissipating substrate 20 can be disposed and retained inside the light-permitting hollow tube 10 without using any retaining structure, for example, the retaining structure may be placed on the inner surface 100 of the light-permitting hollow tube 10 or the two opposite lateral sides 200 of the heat-dissipating substrate 20.

Figure 4:
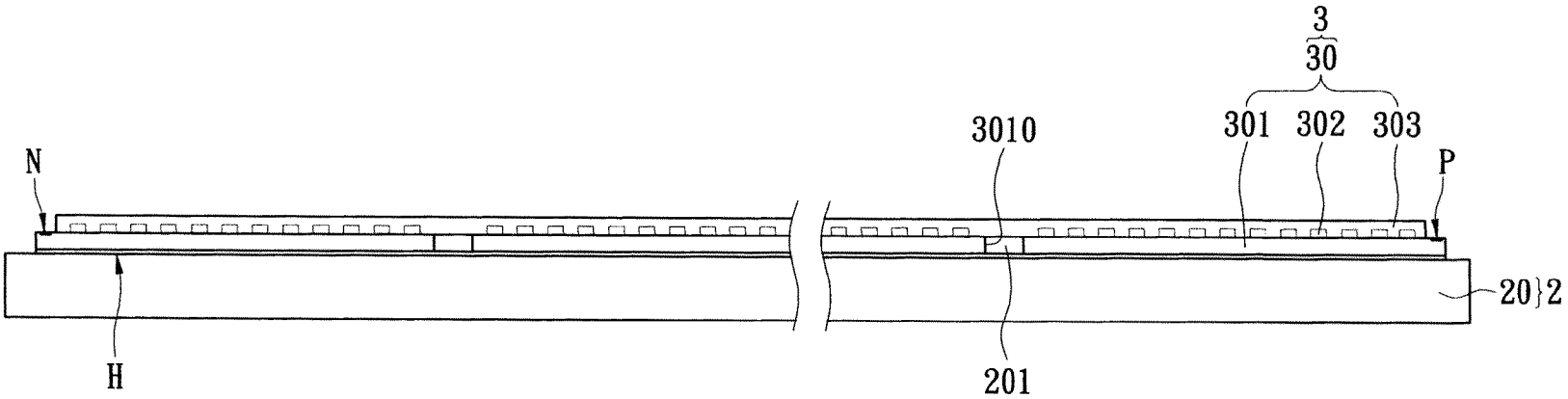
FIG. 4 shows a lateral, schematic view of the heat-dissipating unit mated with the light-emitting unit according to the instant disclosure.
Figure 5:
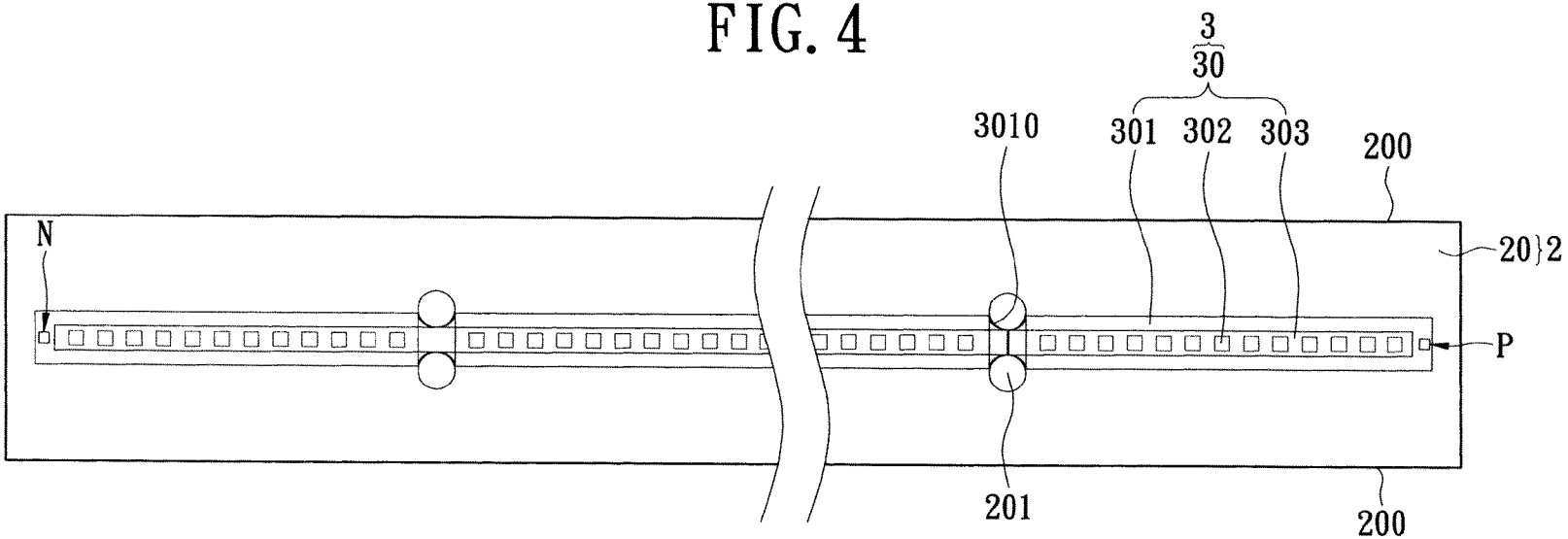
FIG. 5 shows a top, schematic view of the heat-dissipating unit mated with the light-emitting unit according to the instant disclosure.

Referring to FIGS. 1, 4 and 5, the light-emitting unit 3 has a plurality of strip light-emitting modules 30 received in the light-permitting hollow tube 10, and the strip light-emitting modules 30 can be detachably disposed on the heat-dissipating substrate 20 and electrically connected in sequence. In addition, each strip light-emitting module 30 has a circuit substrate 301, a plurality of light-emitting elements 302 electrically connected and disposed on the circuit substrate 301 and a package resin 303 disposed on the circuit substrate 301 to cover the light-emitting elements 302 as shown in FIGS. 4 and 5. The package resin 303 may be a transparent resin or a light-permitting resin mixed with phosphor powders. For example, each light-emitting element 302 may be an LED chip, and each LED chip can be directly disposed on and electrically connected to the circuit substrate 301 (it means COB (Chip On Board)). In other words, each light-emitting element 302 has a positive electrode and a negative electrode respectively and electrically connected to the positive circuit (not shown) and the negative circuit (not shown) of the circuit substrate 301 through two conductive lines (not shown).

Referring to FIGS. 4 and 5, because the strip light-emitting modules 30 can be positioned on the heat-dissipating substrate 20 through heat-conducting adhesive glue H, the strip light-emitting modules 30 can be detachably disposed on the heat-dissipating substrate 20. Of courser, in other embodiment, the heat-dissipating substrate 20 has a plurality of positioning posts 201 disposed on a top surface thereof, the light-emitting unit 3 has a plurality of positioning holes 3010 for respectively receiving the positioning posts 201, and each positioning hole 3010 is formed between every two strip light-emitting modules 30. In other words, glue without heat-conducting and adhesive function can be formed between the strip light-emitting modules 30 and the heat-dissipating substrate 20, and then the strip light-emitting modules 30 can be positioned on the heat-dissipating substrate 20 by matching each positioning hole 3010 and each positioning post 201. Hence, the strip light-emitting modules 30 can be selectively positioned on or detached from the heat-dissipating substrate 20 through heat-conducting adhesive glue H or the match of the positioning post 201 and the positioning holes 3010.

Referring to FIGS. 1, 2 and 6, the support unit 4 has a plurality of support elements 40 received in the light-permitting hollow tube 10 and disposed on a bottom surface of the light-permitting hollow tube 20, and each support element 40 is positioned between the bottom surface of the heat-dissipating substrate 20 and the inner surface 100 of the light-permitting hollow tube 10. For example, each support element 40 may be a metal or plastic elastic piece or an elastic element with any material, each support element 40 has a top portion 400 and an elastic portion 401 extended downward from the top portion 400 (as shown in FIGS. 2 and 6), the top portion 400 of each support element 40 can contact the bottom surface of the heat-dissipating substrate 20, and the elastic portion 401 of each support element 40 can partially or completely contact the inner surface 100 of the light-permitting hollow tube 10. Hence, the heat-dissipating substrate 20 can be pushed upward to the end through the elastic force generated by the elastic support elements 40, thus the two opposite lateral sides 200 of the heat-dissipating substrate 20 can tightly touch the inner surface 100 of the light-permitting hollow tube 10 for firmly positioning the heat-dissipating substrate 20 in the light-permitting hollow tube 10.

Referring to FIGS. 1, 2 and 3, the lateral cover unit 5 has two lateral covers 50 installed on two ends of the light-permitting hollow tube 10, and each lateral cover 50 has a cover body 500 and at least two conductive pins 501 passing through the cover body 500 and respectively electrically connected to the light-emitting unit 3. After the two lateral covers 50 are installed on the two opposite ends of the light-permitting hollow tube 10 (as shown in FIG. 3), the appearance of the illumination lamp tube of the instant disclosure is similar to a traditional fluorescent lamp. Hence, the illumination lamp tube of the instant disclosure can be easily applied to a traditional lamp holder.

Figure 7:
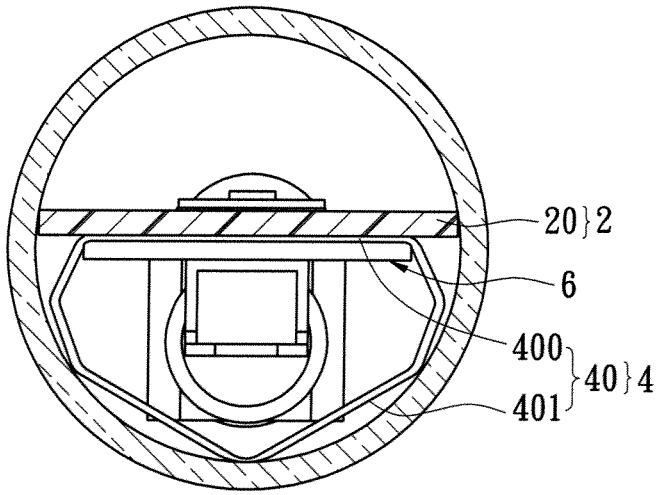
FIG. 7 shows a lateral, cross-sectional, schematic view of the tube unit, the heat-dissipating unit, the light-emitting unit, the support unit and the power conversion unit mated with each other according to the instant disclosure.

Referring to FIGS. 1, 2 and 7, the simple detachable illumination lamp tube further includes a power conversion unit 6 that has at least two alternating current input pads 60 and at least two direct current output pads 61, and the two alternating current input pads 60 are respectively and electrically connected to the at least two conductive pins 501 of each cover element 50, the two direct current output pads 61 are respectively and electrically connected to a positive electrode pad P and a negative electrode pad N of the light-emitting unit 3 (as shown in FIG. 1). Therefore, alternating current (AC) received by the two alternating current input pads 60 can be transformed into direct current (DC) through the power conversion unit 6, and then the direct current can be transmitted to the light-emitting unit 3 through the two direct current output pads 61. In addition, the top portion 400 of each support element 40 is positioned between the bottom surface of the heat-dissipating substrate 20 and a top surface of the power conversion unit 6 (as shown in FIG. 7), thus heat generated by the power conversion unit 6 and heat generated by the strip light-emitting modules 30 can be insulated from each other by the support elements 40 and do not affect each other.

Moreover, referring to FIG. 5, the strip light-emitting modules 30 can be arranged to form a strip shape, and the strip light-emitting modules 30 can be integrated with each other or detachably connected with each other. For example, the two leftmost strip light-emitting modules 30 in FIG. 5 are integrated with each other and the two rightmost strip light-emitting modules 30 in FIG. 5 are detachably connected with each other (there is a cutting slot between the two rightmost strip light-emitting modules 30 that are electrically connected to each other by soldering). Hence, one part of the strip light-emitting modules 30 can be integrated with each other and other part of the strip light-emitting modules 30 can be detachably connected with each other (as shown in FIG. 5) according to different requirements.

Furthermore, the heat-dissipating unit 2 and the light-emitting unit 3 can be combined together to form a simple detachable illumination structure. In addition, the heat-dissipating unit 2 has at least one heat-dissipating substrate 20. The light-emitting unit 3 has a plurality of strip light-emitting modules 30 that are detachably disposed on the heat-dissipating substrate 20 and are electrically connected in sequence, and each strip light-emitting module 30 has a circuit substrate 301, a plurality of light-emitting elements 302 electrically connected and disposed on the circuit substrate 301 and a package resin 303 disposed on the circuit substrate 301 to cover the light-emitting elements 302.

In conclusion, because the strip light-emitting modules can be positioned on the heat-dissipating substrate through heat-conducting adhesive glue, the strip light-emitting modules can be detachably disposed on the heat-dissipating substrate. In addition, the heat-dissipating substrate can be pushed upward to the end through the elastic force generated by the elastic support elements, thus the two opposite lateral sides of the heat-dissipating substrate can tightly touch the inner surface of the light-permitting hollow tube for firmly positioning the heat-dissipating substrate in the light-permitting hollow tube.

The above-mentioned descriptions merely represent the preferred embodiments of the instant disclosure, without any intention or ability to limit the scope of the instant disclosure which is fully described only within the following claims. Various equivalent changes, alterations or modifications based on the claims of instant disclosure are all, consequently, viewed as being embraced by the scope of the instant disclosure.

What is claimed is:

1. A simple detachable illumination lamp tube, comprising:

a tube unit having a light-permitting hollow tube;

a heat-dissipating unit having at least one heat-dissipating substrate received in the light-permitting hollow tube, wherein the at least one heat-dissipating substrate has two opposite lateral sides contacting the inner surface of the light-permitting hollow tube;

a light-emitting unit having a plurality of strip light-emitting modules received in the light-permitting hollow tube, wherein the strip light-emitting modules are detachably disposed on the at least one heat-dissipating substrate and electrically connected in sequence, and each strip light-emitting module has a circuit substrate, a plurality of light-emitting elements electrically connected and disposed on the circuit substrate and a package resin disposed on the circuit substrate to cover the light-emitting elements;

a support unit having a plurality of support elements received in the light-permitting hollow tube and disposed on a bottom surface of the light-permitting hollow tube, wherein each support element is positioned between the bottom surface of the at least one heat-dissipating substrate and the inner surface of the light-permitting hollow tube; and a lateral cover unit having two lateral covers installed on two ends of the light-permitting hollow tube, wherein each lateral cover has a cover body and at least two conductive pins passing through the cover body and respectively electrically connected to the light-emitting unit.

2. The simple detachable illumination lamp tube as claimed in claim 1, wherein the strip light-emitting modules are positioned on the at least one heat-dissipating substrate through heat-conducting adhesive glue, the at least one heat-dissipating substrate has a plurality of positioning posts disposed on a top surface thereof, the light-emitting unit has a plurality of positioning holes for respectively receiving the positioning posts, and each positioning hole is formed between every two strip light-emitting modules.

3. The simple detachable illumination lamp tube as claimed in claim 1, wherein the strip light-emitting modules are arranged to form a strip shape, and the strip light-emitting modules are integrated with each other or detachably connected with each other.

4. The simple detachable illumination lamp tube as claimed in claim 1, wherein the strip light-emitting modules are arranged to form a strip shape, one part of the strip light-emitting modules are integrated with each other and other part of the strip light-emitting modules are detachably connected with each other.

5. The simple detachable illumination lamp tube as claimed in claim 1, wherein each light-emitting element is an LED chip and the package resin is a transparent resin or a light-permitting resin mixed with phosphor powders.

6. The simple detachable illumination lamp tube as claimed in claim 1, wherein each support element is a metal or plastic elastic piece, each support element has a top portion and an elastic portion extended downward from the top portion, the top portion of each support element contacts the bottom surface of the at least one heat-dissipating substrate, and the elastic portion of each support element partially or completely contacts the inner surface of the light-permitting hollow tube.

7. The simple detachable illumination lamp tube as claimed in claim 6, further comprising a power conversion unit having at least two alternating current input pads and at least two direct current output pads, wherein the at least two alternating current input pads are respectively and electrically connected to the at least two conductive pins of each cover element, the at least two direct current output pads are respectively and electrically connected to a positive electrode pad and a negative electrode pad of the light-emitting unit, and the top portion of each support element is positioned between the bottom surface of the at least one heat-dissipating substrate and a top surface of the power conversion unit.

8. A simple detachable illumination lamp tube, comprising:

a tube unit having a light-permitting hollow tube;

a heat-dissipating unit having at least one heat-dissipating substrate received in the light-permitting hollow tube, wherein the at least one heat-dissipating substrate has two opposite lateral sides contacting the inner surface of the light-permitting hollow tube;

a light-emitting unit having a plurality of strip light-emitting modules received in the light-permitting hollow tube, wherein the strip light-emitting modules are disposed on the at least one heat-dissipating substrate and electrically connected in sequence;

a support unit having a plurality of support elements received in the light-permitting hollow tube and disposed on a bottom surface of the light-permitting hollow tube, wherein each support element is positioned between the bottom surface of the at least one heat-dissipating substrate and the inner surface of the light-permitting hollow tube; and a lateral cover unit having two lateral covers installed on two ends of the light-permitting hollow tube, wherein each lateral cover has a cover body and at least two conductive pins passing through the cover body and respectively electrically connected to the light-emitting unit.

9. The simple detachable illumination lamp tube as claimed in claim 8, wherein the strip light-emitting modules are positioned on the at least one heat-dissipating substrate through heat-conducting adhesive glue, the at least one heat-dissipating substrate has a plurality of positioning posts disposed on a top surface thereof, the light-emitting unit has a plurality of positioning holes for respectively receiving the positioning posts, and each positioning hole is formed between every two strip light-emitting modules.

10. The simple detachable illumination lamp tube as claimed in claim 8, wherein the strip light-emitting modules are arranged to form a strip shape, and the strip light-emitting modules are integrated with each other or detachably connected with each other.

11. The simple detachable illumination lamp tube as claimed in claim 8, wherein the strip light-emitting modules are arranged to form a strip shape, one part of the strip light-emitting modules are integrated with each other and other part of the strip light-emitting modules are detachably connected with each other.

12. The simple detachable illumination lamp tube as claimed in claim 8, wherein each light-emitting element is an LED chip and the package resin is a transparent resin or a light-permitting resin mixed with phosphor powders.

13. The simple detachable illumination lamp tube as claimed in claim 8, wherein each support element is a metal or plastic elastic piece, each support element has a top portion and an elastic portion extended downward from the top portion, the top portion of each support element contacts the bottom surface of the at least one heat-dissipating substrate, and the elastic portion of each support element partially or completely contacts the inner surface of the light-permitting hollow tube.

14. The simple detachable illumination lamp tube as claimed in claim 13, further comprising a power conversion unit having at least two alternating current input pads and at least two direct current output pads, wherein the at least two alternating current input pads are respectively and electrically connected to the at least two conductive pins of each cover element, the at least two direct current output pads are respectively and electrically connected to a positive electrode pad and a negative electrode pad of the light-emitting unit, and the top portion of each support element is positioned between the bottom surface of the at least one heat-dissipating substrate and a top surface of the power conversion unit.

* * * * *